US011069166B2

(12) United States Patent
Neiman et al.

(10) Patent No.: US 11,069,166 B2
(45) Date of Patent: Jul. 20, 2021

(54) SECURED CUSTOMER ACCESS ARRANGEMENT FOR A CONTAINER BUSINESS

(71) Applicant: 2654184 Ontario Inc., Toronto (CA)

(72) Inventors: Yakov Neiman, Toronto (CA); Dmitri Melamed, Toronto (CA); Michael Girgis, Toronto (CA); Idan Mizrahi, Toronto (CA)

(73) Assignee: 2654184 Ontario Inc., Toronto (CA)

( * ) Notice: Subject to any disclaimer, the term of this patent is extended or adjusted under 35 U.S.C. 154(b) by 0 days.

(21) Appl. No.: 16/843,375

(22) Filed: Apr. 8, 2020

(65) Prior Publication Data

US 2020/0327759 A1 Oct. 15, 2020

(30) Foreign Application Priority Data

Apr. 9, 2019 (CA) ..... CA 3039555

(51) Int. Cl.
*G07C 9/25* (2020.01)
*G07C 9/10* (2020.01)

(52) U.S. Cl.
CPC *G07C 9/25* (2020.01); *G07C 9/10* (2020.01)

(58) Field of Classification Search
CPC ..... G07C 9/25; G07C 9/10
See application file for complete search history.

(56) References Cited

U.S. PATENT DOCUMENTS 5,706,616 A * 1/1998 Fernandez ..... B60P 3/0252 296/24.3
2006/0107614 A1* 5/2006 Slagel ..... E04H 1/00 52/750
2011/0178630 A1* 7/2011 Green ..... G07C 9/00896 700/214
2011/0313811 A1* 12/2011 Urban ..... B60P 3/0257 705/7.25
2012/0148020 A1* 6/2012 Arroyo, Jr. ..... G01V 3/165 378/57
2018/0144563 A1* 5/2018 Reymann ..... E06B 11/02

* cited by examiner

*Primary Examiner* — Mohammed Barakat
(74) *Attorney, Agent, or Firm* — Banner & Witcoff, Ltd.

(57) ABSTRACT

A container is provided which is modified to operate for a secure business (e.g. a retail business for the sale of a restricted access product). The container has a first pair of opposing sides and a second pair of opposing sides with a first door leading into a security vestibule. A second door is provided from the security vestibule into a restricted access space (e.g. an interior retail space, in which a restricted access product is displayed and available for sale). A security checkpoint is provided in the security vestibule. The first door and the second door are offset from each other such that restricted access space is not visible to a visitor without passing the security checkpoint. A method of permitting access to a restricted access product for sale through a modified container is also provided.

18 Claims, 5 Drawing Sheets

SECURED CUSTOMER ACCESS ARRANGEMENT FOR A CONTAINER BUSINESS

The present application claims the benefit of priority of CA 3039555 filed Apr. 9, 2019, which is incorporated by reference herein in its entirety.

FIELD OF THE INVENTION

The invention relates to streamlined yet secure physical premises for container businesses.

BACKGROUND

The use of converted multimodal shipping containers (and other portable prefab units) as retail businesses has become a worldwide phenomenon. The relative low-cost, compact size, and versatility of containers has contributed to this popularity.

Typically, a container is converted into a retail space mainly by cutting one large service window that can be opened for receiving customers in a walk-up fashion. The container already has cargo doors allowing staff entry/exit and loading/unloading of goods and business supplies. The conversion requirements are minimal.

Such types of converted containers lend themselves well to businesses like cafes and market-type shops selling, for example, jewelry and other artisan goods. Such businesses may of necessity be seasonal, as the containers themselves may not be insulated, and the "open window" concept is not suited to cold or wet weather.

While the single walk-up window model is convenient and efficient for consumers, the model does not work for all types of businesses. For instance, the model does not contemplate the security demands of certain types of businesses, which expect to have consumer traffic through the store, not simply adjacent to a window, but which also require additional security or control measures. Some businesses, due to the high value or regulatory requirements associated with their products, need to provide additional layers of security or compliance. For instance, products that are very high value (e.g. high end jewelry) are typically sold out of permanent bricks and mortar retail establishments where there may be, for example, secure displays, barred windows, internal vaults. Products may also be restricted on age or other grounds (e.g. alcoholic beverages, tobacco, adult products/literature), or dispensed through licensed personnel or establishments (e.g. pharmacies, dispensaries). To date, containers have not been considered to meet these types of requirements. Further, certain types of service and facility providers (e.g. regulated alcohol, tobacco, or drug consumption establishments, gaming establishments, VIP lounges, etc.) may also require secure customer/guest access for age/identity verification, maximum occupancy, fire code, safety, or other reasons.

It would be desirable to provide a design of modified container that is both efficient for consumers to engage with the business on a walk-through basis, while providing for the security and compliance aspects needed for certain types of businesses.

SUMMARY OF THE INVENTION

According to a first aspect of the invention, a container is provided which is modified to operate for a secure business. The container has a first pair of opposing sides and a second pair of opposing sides with a first door leading into a security vestibule. A second door is provided from the security vestibule into a restricted access space in which certain products, services or privileges may be accessed. A security checkpoint is provided in the security vestibule. The first door and the second door are offset from each other such that the restricted access space is not visible to the visitor without passing the security checkpoint.

According to a second aspect of the invention, a container is provided which is modified to operate as a secure retail business for the sale of a restricted access product. The container has a first pair of opposing sides and a second pair of opposing sides with a first door leading into a security vestibule. A second door is provided from the security vestibule into an interior retail space, in which the restricted access product is displayed and available for sale. A security checkpoint is provided in the security vestibule. The first door and the second door are offset from each other such that neither the interior retail space nor the restricted access product is visible to a visitor without passing the security checkpoint.

By "secure business" we refer here to a commercial establishment providing any type of product or service or environment that by virtue of the value or nature of the product or service or environment, or its associated regulatory environment, has attendant security requirements. By "secure retail business" we refer to a retail type of such establishment, specifically engaging in product transactions. By "restricted access product" we refer to a commercial product that has restrictions on access due to, for example, age, legal status, client relationship or prescription. Included with such restricted access products for the purpose of this disclosure are advertisements (in any medium) and displays that pertain to such products. One such product is cannabis products, which are fully legal in some jurisdictions, and legal as a medical product in some jurisdictions, but always with restrictions as to who may legally purchase. While some cannabis-related examples may be given in the present disclosure as an illustration, the invention is not limited to cannabis products or cannabis businesses, and it is not intended to promote or endorse such products or businesses where they are not legal. Other such products include tobacco (or e-cigarette or vaped) products, alcohol and other restricted substances.

Preferably, the first door is an exterior door while the second door is an interior door. (Note that "interior" and "exterior" are used here in a relative sense. The "exterior" door may in fact be provided in a wall that is inside of the original cargo doors of the container (a wall that only becomes "exterior" when the cargo doors are open).

The checkpoint may be an automated security gate. For instance, an automated security gate may be provided that is opened with a valid ID scan or a valid biometric scan. Other manual and automatic security cordons and gates may be employed.

In certain embodiments, the first door and the second door cannot be opened at the same time. The second door is preferably in any event closed until the automated security gate is opened.

In certain embodiments, the second door blocks egress of oxygen and/or humidity from the interior retail space.

The interior retail space of the container preferably has a display/ordering area that is physically separate from a service/pickup area. The service/pickup area may be located at an end of the container that is opposite to the second door.

The container may further include a third door for visitors to exit from the interior retail space without passing back through the security checkpoint.

Preferably, the third door is on a separate side of the container, and spaced away from, the first door (e.g. a long side of the container adjacent to the end of the container on which the first door is disposed, so that the first door is "kitty-corner" to the third door).

The container may further include at least one window in an exterior wall. Preferably, the window is a one-way window (e.g. one way glass or filmed or screened) to admit light into the interior retail space without permitting visibility of the restricted access product or the visitors from outside.

According to a third aspect of the invention, a method is provided for permitting access to a restricted access product for sale through a modified container. A visitor is provided with access into a security vestibule of the container through a first door disposed on a side of the container. The visitor must clear a security checkpoint in the security vestibule before the visitor can open a second interior door in the container to enter into an interior retail space in which the restricted access product is displayed and available for sale. The second door, the security checkpoint and the first door are disposed relative to each other such that neither the interior retail space nor the restricted access product is visible to the visitor from the first door. The interior retail space beyond the second door has designated display/ordering and service/pickup areas to obtain the restricted access product. The visitor exits the container through a third door off the interior retail space without passing back through the security checkpoint.

The restricted access product may be an age-restricted product (e.g. alcohol, tobacco), and in one embodiment may be a cannabis product.

BRIEF DESCRIPTION OF THE FIGURES

FIG. 5 also shows the areas in which each step takes place.

DETAILED DESCRIPTION

Figure 1:
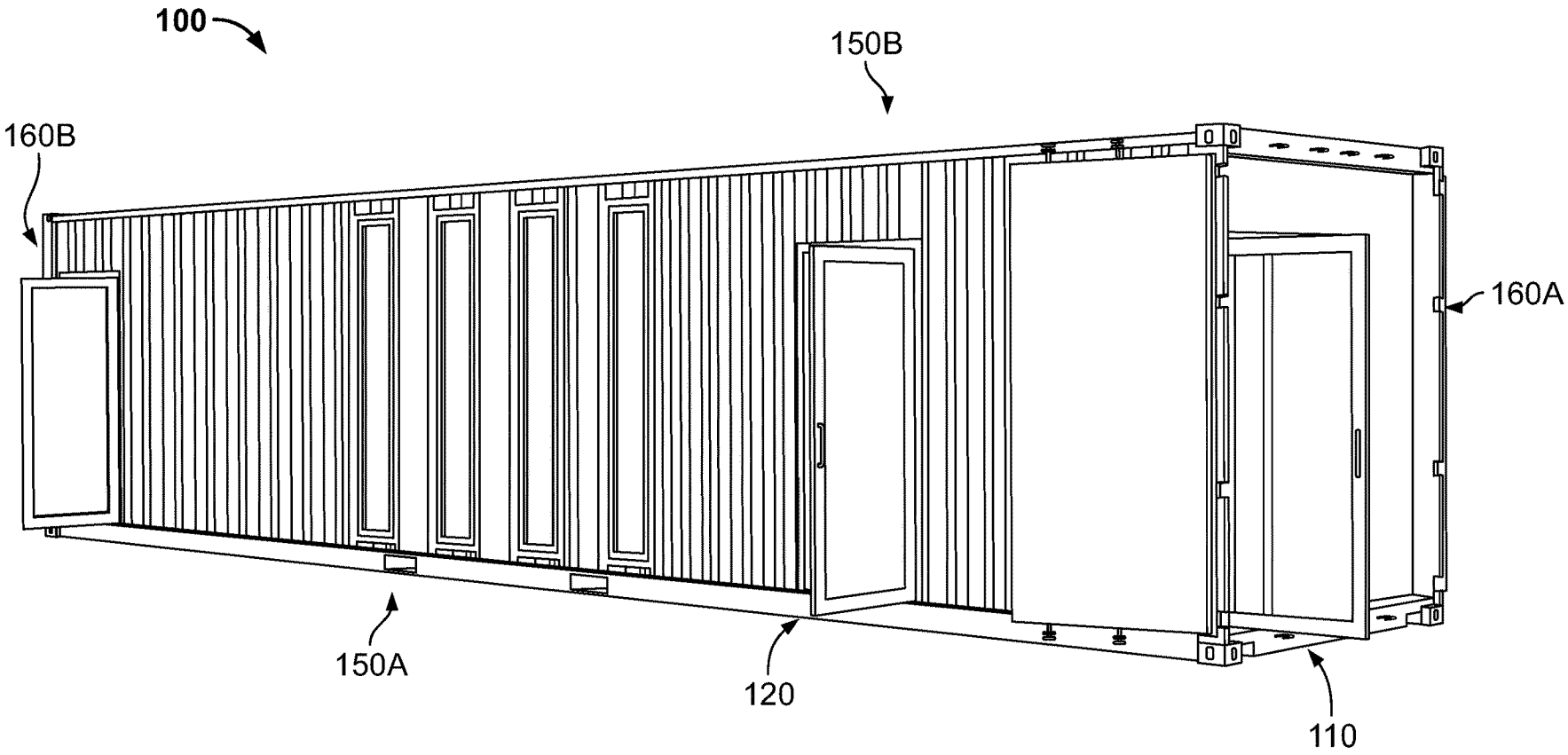
FIG. 1 is an exterior perspective view of an embodiment of the container for secure retail of a restricted access product showing first (entry) door and third (exit) door.

A view of a sample converted shipping container 100 for a secure retail business is shown in FIG. 1. (It will be appreciated that in fact this can be any type of portable building structure of the type that is prefabricated so that it can be dropped into a location. The term "container" is used throughout the present disclosure with this broad connotation in mind.) The container 100 has in a typical configuration: a first pair of opposite (here, short) sides 160A, 160B; and a second pair of opposite (here, long) sides 150A, 150B. Square (and other) container shapes are also possible. Certain possible windows and doors of the conversion have been shown. Of note, a customer entry door (called elsewhere the "first door" 110) and exit door (called elsewhere the "third door" 120) are provided. Other details of the converted shipping container that may be needed in order to fit it for use as a semi- or fully-permanent retail establishment (e.g. slab foundation and/or decking/stairs, water and power hookups, heating/cooling and ventilation apparatus) have been omitted from the drawings for simplicity.

Figure 2A:
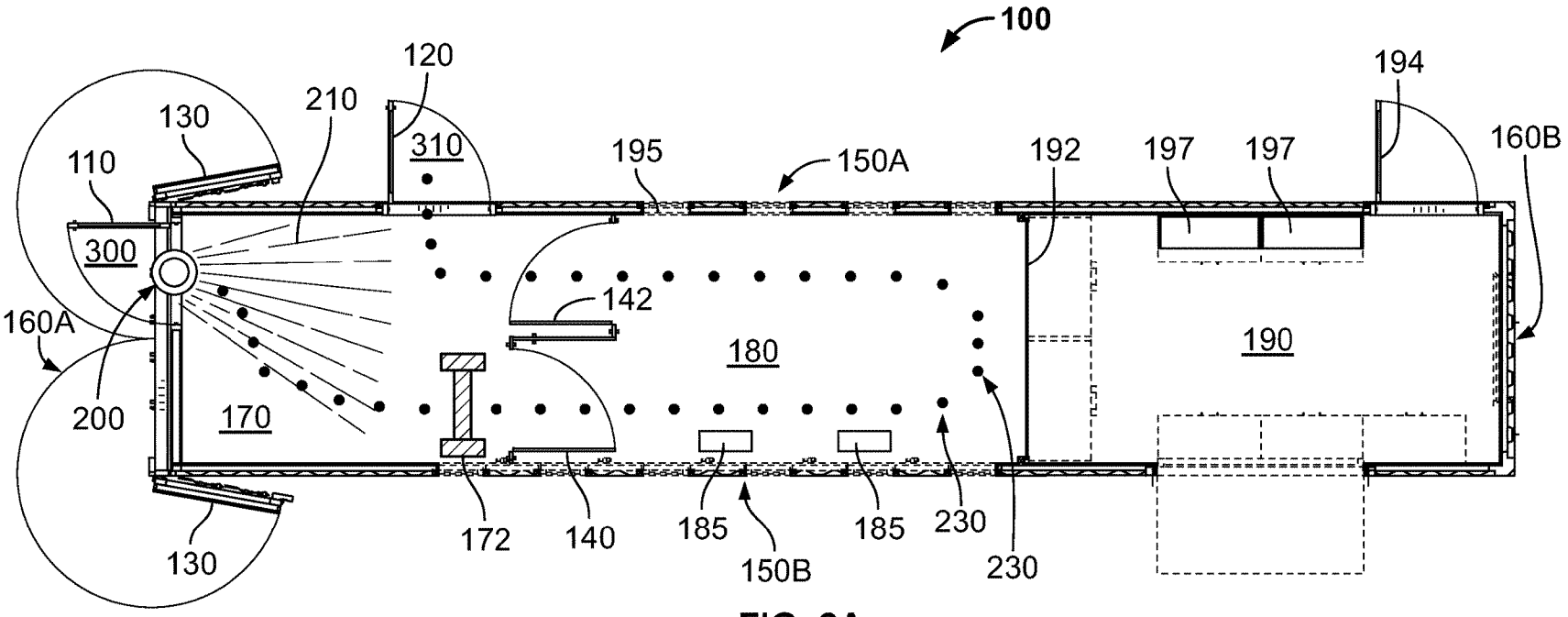
FIG. 2A is a layout (floorplan) view of the embodiment of FIG. 1 showing field of view of visitor from first (entry) door and interior walkthrough path crossing security checkpoint in security vestibule, second door, interior retail space with display/ordering and service/pickup areas, and third (exit) door.

The container is shown in more detail in layout form in FIG. 2A. In general, the container has three main physical zones: a security vestibule 170; an interior retail space 180; and a pickup/service area 190. Of these, a customer will typically only enter into (pass through) the security vestibule 170 and the interior retail space 180. The customer will typically approach without entering the pickup/service area 190 via counter 192 (staff may be provided behind the counter in a typical embodiment). The general walking pattern of a customer through the secure container business is illustrated with dotted pattern 230. (Staff may be entering/exiting through a separate access door 194). It will be appreciated that the interior retail space may in fact be any type of restricted access space, with or without specific products being sold.

In the embodiment shown, the container is a typical corrugated multimodal steel container of the type well known. The original equipment of the container may include fully-openable hinged cargo doors 130. In a typical well-known configuration, these may be padlocked or otherwise secured together when fully closed. In the modification for the secure container business, the container may be further sealed, insulated and ventilated, and heat and cooling, water and plumbing access may be provided (not shown).

The customer entry 300 is preferably generally provided on the cargo door side (one of the two short sides), while the customer exit 310 is preferably generally provided on one of the adjacent long sides.

The entry is preferably provided via first door 110, through which the visitor 200 is admitted into the security vestibule 170. The security vestibule is a type of antechamber before the actual premises of the business where the restricted access product is promoted and/or transacted. The security vestibule is preferably walled off from the interior retail space by means of a wall and a second door 140, which is ordinarily closed. (Another interior door 142 may be provided to facilitate exit from the container, which will also be ordinarily closed.) A security checkpoint (e.g. security gate 172) is provided in the security vestibule, so that only valid customers may enter through the second door. (Separate security requirements may be provided for staff.)

Figure 2B:
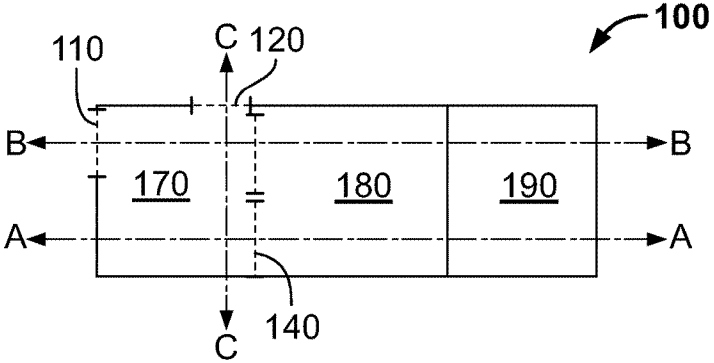
FIG. 2B is a simplified layout view showing offset axes of the first (entry) door (longitudinal axis A), second (interior) door (longitudinal axis B), and third (exit) door (transverse axis C).

From the position at the first door, the visitor/customer 200 has a limited field of view 210 due to the closed door(s)/walls and security checkpoint of the security vestibule. The restricted access product is not accessible or visible in the security vestibule. In some embodiments, even if the second door 140 is open, the position of the first door, and the position of the security gate (or other checkpoint) make it impossible to see into the interior retail space (or the portions of the interior retail space where the restricted access product is shown or promoted or transacted). This may be simply because the longitudinal axis of the entrance and first door 110 (axis B) notionally through the container is offset from the longitudinal axis of the second door 140 (axis A) notionally through the container. The exit through third door 120 is preferably on a transverse (shortwise) axis (axis C) through the container, all as illustrated conceptually in FIG. 2B.

There are multiple ways to limit the field of view, and in addition to the arrangement of doors and checkpoints described here, there may be other visual barriers, curtains, screens, etc.

Figure 3A:
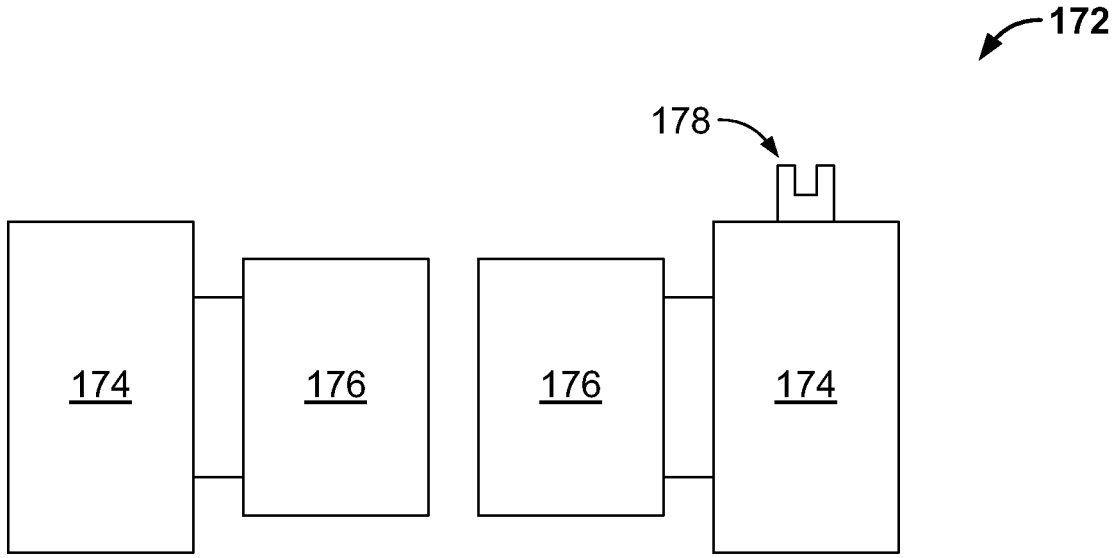
FIG. 3A is a conceptual diagram of a security checkpoint (here, automated gate using card scan).
Figure 3B:
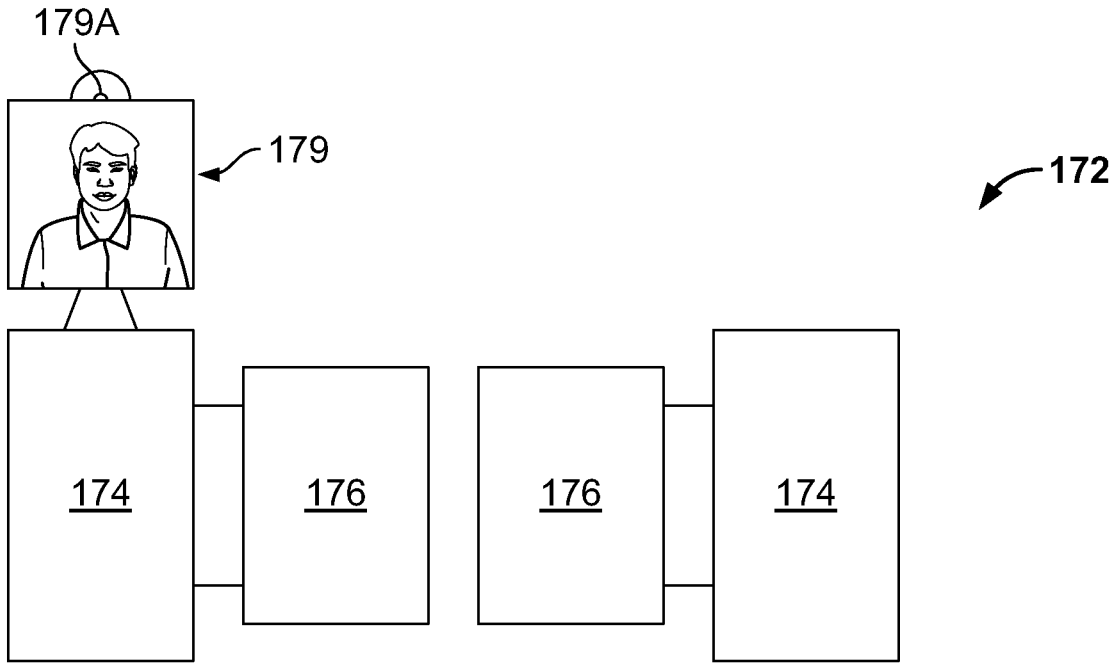
FIG. 3B is a conceptual diagram of a security checkpoint (here, automated gate using biometric scan).

One type of security checkpoint is a security gate 172. Some simple types of automated security gates are illustrated in FIGS. 3A and 3B. For example, an automated pair of actuatable security doors 176, 176 may be provided between secure gantry elements 174, 174. A card reader 178 may be provided to read visitor access cards or identification to validate for age or other restrictions prior to opening the doors. Alternatively, a biometric scanning unit 179 may be provided with a camera 179A, which may be interpreted in combination with a database of valid biometric identifiers (or in combination with scanned card ID) to validate for age or other restrictions prior to opening the doors. Comparisons of such card or biometric identification with databases of valid (or invalid) identifications or identities may be done using a localized server or by transmission to an outside hosted server. In some cases, the decision-making is entirely local, while in others, a remote authority is referred to. In some cases, the identification of the actual person is not as critical as the validity of the identified birthdate or other approved status (e.g. prior membership or profile on file). Personal information may or may not be stored. In some embodiments, it may be preferred to automatically expire (or store in transient memory) any received identification or biometric parameters as soon as a validation decision is made in order to preserve anonymity of customers. In other embodiments (not shown), a live camera and an ID scanner may be provided to validate that the person is who they claim they are, in an implementation similar to certain present ITMs (Interactive teller machines). In such an embodiment, an ID is placed on a reader and transmitted to an operator. The operator verifies the ID and the presence of a customer on file and checks the live camera feed to confirm that the ID matches the person.

Figure 4:
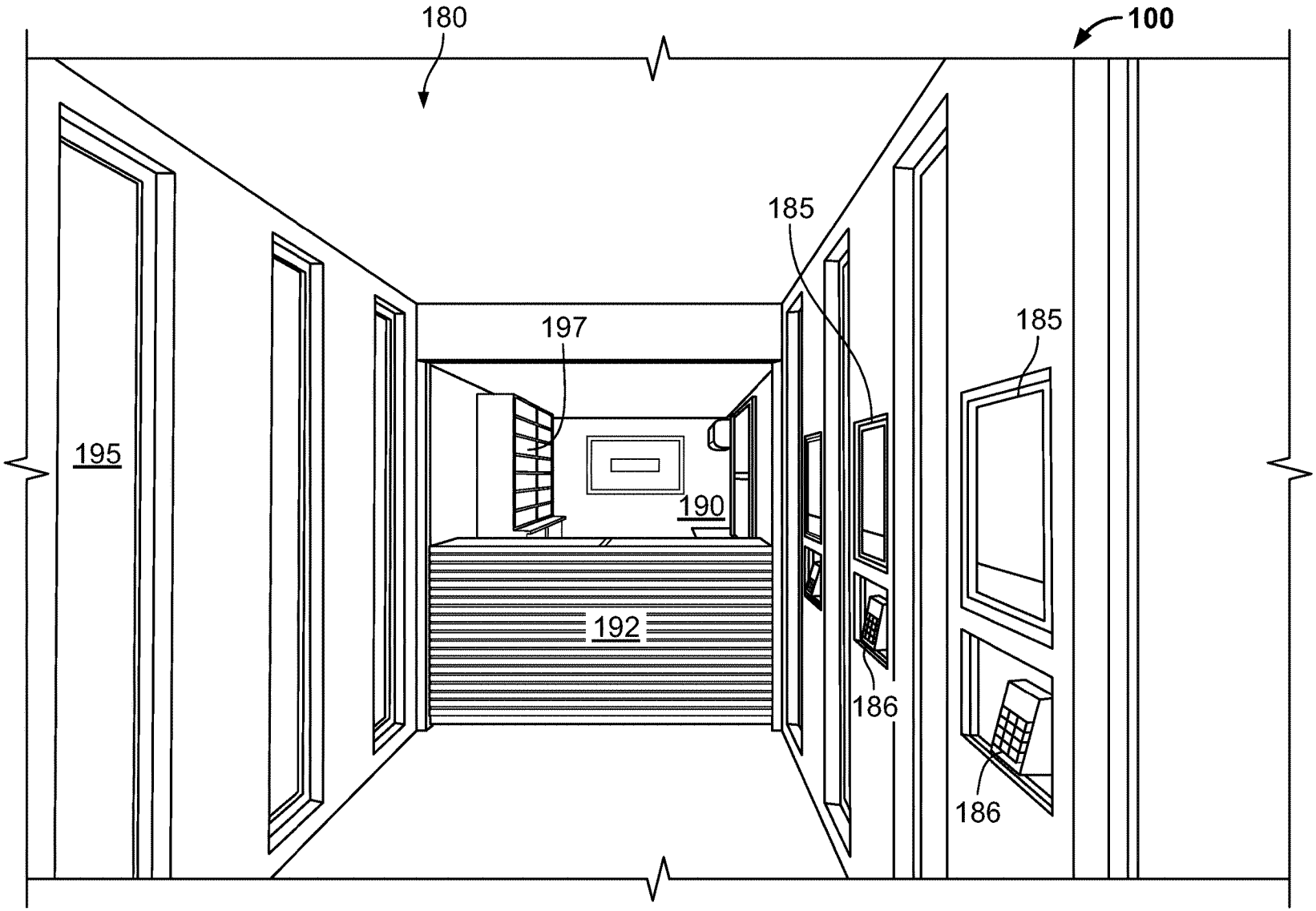
FIG. 4 is a perspective view of the interior retail space with display/ordering area and service/pickup area.

Having cleared the security checkpoint and passed through the second door 140, the customer enters into the interior retail space 180. One conception of this space is shown for example in FIG. 4. For compactness and ease of walkthrough traffic, the space may be provided on one side (or both sides) with promotional/ordering kiosks 185 which may display all of the types of restricted access products available together with price and other descriptive information. Preferably, the kiosks will also have real-time access to product inventory. In one embodiment, upon ordering from the kiosk, a confirmation/reservation number will be provided to the user. The number will be used at the product redemption area to get the merchandise. Payment terminals 186 may also be provided to facilitate immediate payment processing for the products ordered. For example, tap, dip and swipe (3-in-1) terminals may be provided for easy payment. The 3-in-1 approach permits collection of funds beyond $99 and will require a dip+pin authentication. The terminals may also support mobile wallets (e.g. Google Pay, Apple Wallet, Samsung Pay and any other mobile based payments).

In some embodiments, windows 195 or skylights may be provided to add natural light to the space. But preferably, the particulars of the products (as seen from the ordering kiosks 185 or through other displays or promotional materials, not shown) are not visible from outside the container. This may be accomplished through one-way glass or other etching/shading/filming of the windows.

The ordered and paid products can then be picked up at a service counter 192. Staff may be involved in packing (or co-packing) ordered and paid products (e.g. from storage cabinets 197). Optionally, additional security or ID protocols may be used at pickup. In certain embodiments, the staff may serve as live attendants providing education and advice, for example, to help customers identify the right product for them. Counter staff may also interface with ID (or other verification) technology that is checking in people walking into the double door security checkpoint.

Fully automated (non-staffed) embodiments are also contemplated. For example, instead of ordering kiosks 185 with product pickup at counter 192, fully automated vending machine type terminals (not shown) may be provided, so that no separate pickup/service area 190 is necessary. In some embodiments, automated, industrial lockers (similar to Amazon's delivery lockers used at Whole Foods) with a digital pin pad could be used to store merchandise. In such embodiments, using a one-time redemption code, buyers would access a single locker containing their product.

After pickup, the customer preferably makes his/her way to the third door 120 for exit from the container, preferably without re-crossing traffic from the entrance/security vestibule traffic stream. In some embodiments, temporary or permanent traffic dividers or rails may be provided (not shown) to further separate the traffic streams.

The combination of (ordinarily-closed) first, second, and third doors also provides a semi-airlock system, which may be particularly beneficial for environmentally delicate or fragile products, or products subject to premature staling or loss of potency in the presence of excessively high or low temperatures, or excessively high or low humidity (which may include some cannabis products). To further protect such products, the second door 140 (and optionally other interior door 142), which effectively divides the space, may be provided with counteracting humidifying or dehumidifying or temperature control devices, such as air scrubbers, microcontroller connected humidifiers and dehumidifiers. The storage of such products in cabinets 197 may also be provided with environmental controls (e.g. localized humidor-like climate controls). Again, these are not precautions generally taken in a conventional container business.

Figure 5:
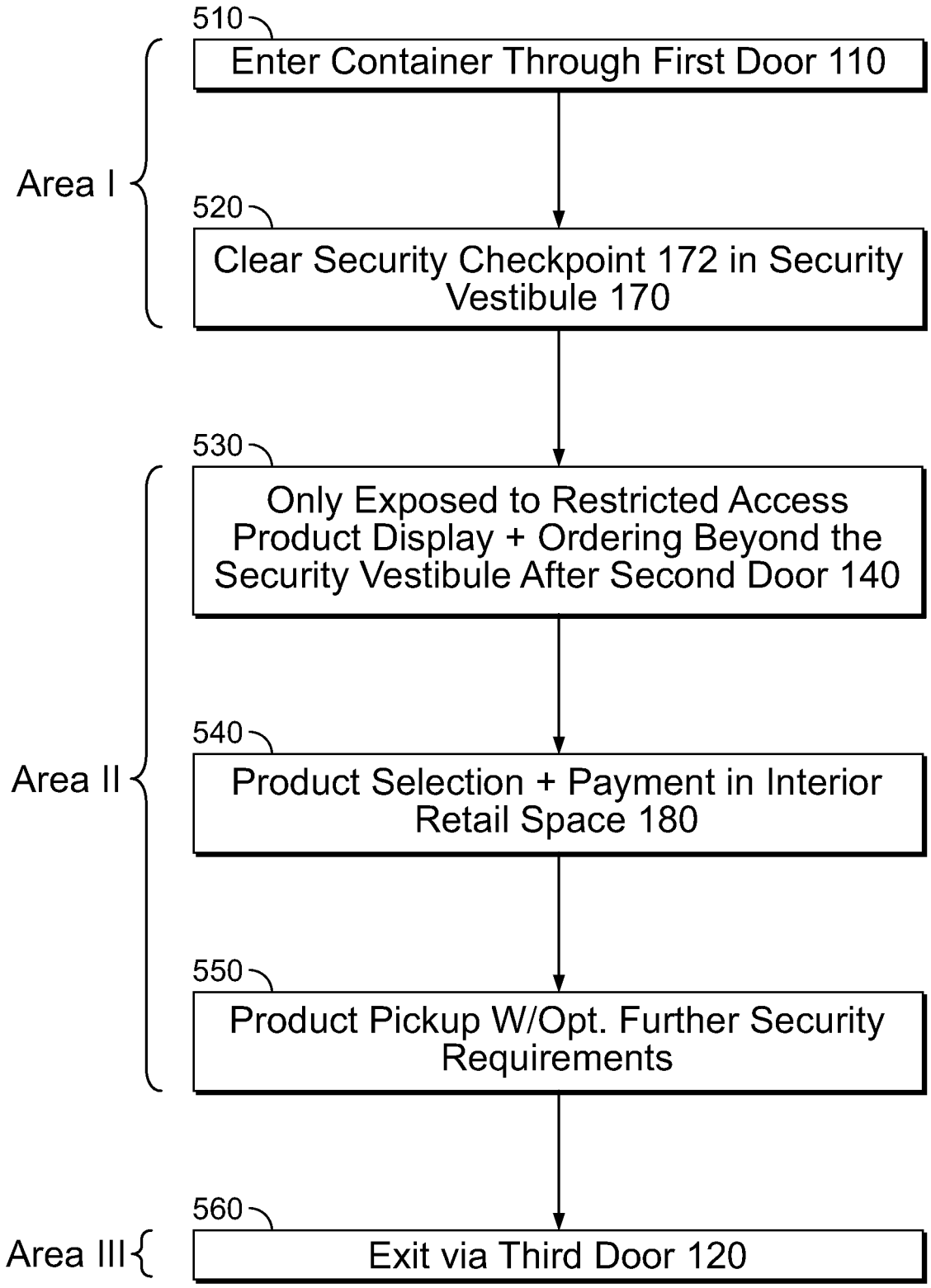
FIG. 5 is a flow diagram of an embodiment of the method of accessing a restricted access product for sale through modified container.

An embodiment of the method is illustrated in flow diagram in FIG. 5. First, the visitor enters the container through the first door 510. Next, a security checkpoint is provided in this security vestibule and the visitor must clear the security checkpoint prior to moving on 520. Importantly, the visitor is only exposed to the restricted access product beyond the security vestibule after the second door 530. At this point, the visitor can select the product and make payment within the interior retail space 540. Then, the visitor can pick-up the ordered and paid-for product 550, while complying with any necessary further security requirements (optional). Finally, the visitor exits via the third door 560.

To ensure traffic efficiency, while maintaining the integrity of the separated system, these steps may be thought of as occurring in three separate transactional (or business) zones/areas:

Area I Pre-clearance area (roughly corresponding to the entrance and security vestibule)

Area II Cleared area for viewing and purchase of product, and pickup (roughly corresponding to the interior retail space and customer-facing part of the pickup/service area 190)

Area III Exit area (preferably without recrossing traffic streams entering and clearing security)

In order to promote comprehension of the components of the present specification, relative terms such as up, down, upper, lower, left, right, top, bottom, inner, outer, and so forth, have been used (generally for consistency with the orientations of the components as shown in the figures). It will be appreciated that these may, in some cases, be subject to overall orientation of the container and its fittings and are not intended to state absolutes.

The scope of the claims should not be limited by the preferred embodiments set forth in the foregoing disclosure, but should be given the broadest purposive construction consistent with the description as a whole and having regard to equivalents set forth or implied.

What is claimed is:

1. A container modified to operate for a secure business, comprising:

a container having a first opposing pair of sides and a second opposing pair of sides;

a first door leading into a security vestibule;

a second door leading from the security vestibule into a restricted access space, in which certain products, services or privileges may be accessed;

a security checkpoint in the security vestibule;

wherein the first door and the second door are offset from each other such that the restricted access space is not visible to a visitor without passing the security checkpoint.

2. A container modified to operate as a secure retail business for sale of a restricted access product, comprising:

a container having a first opposing pair of sides and a second opposing pair of sides;

a first door leading into a security vestibule;

a second door leading from the security vestibule into an interior retail space, in which the interior retail space includes the restricted access product which is displayed and available for sale;

a security checkpoint in the security vestibule;

wherein the first door and the second door are offset from each other such that neither the interior retail space nor the restricted access product is visible to a visitor without passing the security checkpoint.

3. The container of claim 2, wherein the first door is an exterior door and the second door is an interior door.

4. The container of claim 2, wherein the checkpoint is an automated security gate.

5. The container of claim 4, wherein the automated security gate is opened with a valid ID scan.

6. The container of claim 4, wherein the automated security gate is opened with a valid biometric scan.

7. The container of claim 2, wherein the first door and the second door cannot be opened at the same time.

8. The container of claim 4, wherein the second door is closed until the automated security gate is opened.

9. The container of claim 2, wherein the second door blocks egress of oxygen from the interior retail space.

10. The container of claim 2, wherein the second door blocks egress of humidity from the interior retail space.

11. The container of claim 2, wherein the interior retail space has a display/ordering area that is physically separate from a service/pickup area.

12. The container of claim 11, wherein the service/pickup area is at an opposite end of the container from the second door.

13. The container of claim 2, further comprising a third door for visitors to exit from the interior retail space without passing back through the security checkpoint.

14. The container of claim 13, wherein the third door is on a long side of the container and spaced away from the first door.

15. The container of claim 2, further comprising at least one window in an exterior wall of the container.

16. The container of claim 15, wherein the window is a one-way window which admits light into the interior retail space without permitting visibility of the restricted access product or the visitors from outside.

17. A method of permitting access to a restricted access product for sale through a modified container, comprising:

providing a visitor access into a security vestibule of the container through a first door disposed on a side of the container;

providing a security checkpoint in the security vestibule which must be cleared before the visitor can open a second interior door in the container to enter into an interior retail space in which the restricted access product is displayed and available for sale;

the second door, the security checkpoint and the first door being disposed relative to each other such that neither the interior retail space nor the restricted access product is visible to the visitor from the first door;

providing the interior retail space beyond the second door, the interior retail space having designated display/ordering and service/pickup areas to obtain the restricted access product; and providing a third door for exiting the container from the interior retail space without passing back through the security checkpoint.

18. The method of claim 17, wherein the restricted access product is an age-restricted product.

* * * * *